US008807341B2

(12) United States Patent
Chan et al.

(10) Patent No.: US 8,807,341 B2
(45) Date of Patent: Aug. 19, 2014

(54) CUSHION

(75) Inventors: Tai-Ling Chan, Hsin-Chu (TW); Chung-Yu Mao, Hsin-Chu (TW); Chung-Kuan Ting, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 82 days.

(21) Appl. No.: 13/589,262

(22) Filed: Aug. 20, 2012

(65) Prior Publication Data

US 2013/0233759 A1 Sep. 12, 2013

(30) Foreign Application Priority Data

Mar. 9, 2012 (CN) ..... 2012 1 0065320

(51) Int. Cl.
*B65D 85/30* (2006.01)

(52) U.S. Cl.
USPC ..... 206/523; 206/586; 206/593

(58) Field of Classification Search
USPC ..... 206/523, 586, 587, 591, 592, 593, 594
See application file for complete search history.

(56) References Cited

U.S. PATENT DOCUMENTS

| | | | | | |
|---|---|---|---|---|---|
| 3,994,433 | A * | 11/1976 | Jenkins et al. | ..... | 206/586 |
| 4,869,369 | A * | 9/1989 | Turngren | ..... | 206/523 |
| 4,972,954 | A * | 11/1990 | Dickie | ..... | 206/523 |
| 5,207,327 | A * | 5/1993 | Brondos | ..... | 206/523 |
| 6,868,965 | B2 * | 3/2005 | Miller et al. | ..... | 206/320 |
| 6,877,605 | B2 * | 4/2005 | Tsai | ..... | 206/326 |
| 7,452,316 | B2 * | 11/2008 | Cals et al. | ..... | 493/95 |
| 7,654,391 | B2 * | 2/2010 | Langer et al. | ..... | 206/523 |
| 7,757,861 | B2 * | 7/2010 | Wang et al. | ..... | 206/591 |
| 2008/0277312 | A1 * | 11/2008 | Eren et al. | ..... | 206/701 |

FOREIGN PATENT DOCUMENTS

| | | |
|---|---|---|
| CN | 101875424 | 9/2011 |
| TW | M253163 | 12/2004 |
| TW | 200824970 | 6/2008 |
| TW | I326402 | 10/2008 |
| TW | M356903 | 5/2009 |
| TW | 201109244 | 3/2011 |

* cited by examiner

*Primary Examiner* — Jacob K Ackun
(74) *Attorney, Agent, or Firm* — WPAT, PC; Justin King

(57) ABSTRACT

A cushion for cushioning an article is provided. The cushion includes a base plate, a first protruding structure, and a second protruding structure. The base plate is used to supporting the article. The first protruding structure includes a main body and a rotation block. The main body is connected to the base plate. The rotation block is connected to the main body and is capable of being bent to rotate toward the base plate relative to the main body. The second protruding structure is connected to the base plate. The article is clamped between the bent rotation block and the second protruding structure.

12 Claims, 13 Drawing Sheets

CUSHION

RELATED APPLICATIONS

This application claims priority to China Application Serial Number 201210065320.6, filed Mar. 9, 2012, which is herein incorporated by reference.

BACKGROUND

1. Technical Field

The present disclosure relates to a cushion, and more particularly, to a cushion for protecting an electronic apparatus.

2. Description of Related Art

Many thin articles use brittle plates, such as a Liquid Crystal Display (LCD) panel. During manufacturing processes of the articles, the brittle plates must be transported to downstream manufacturers. The brittle plates are costly and easily broken, so how to reduce or prevent damages during transportation is one of the important issues in the field. Before transported, a thin article is accommodated in a box, and fixing structures that fit with the appearance of the article are used to package the article in the box. The remaining space in the box is filled with cushions such as foam materials to buffer an external impact force, so as to prevent the article from broken. Conventional cushions are usually made of Styrofoam or bubble papers. Because the conventional cushions are easy to be manufactured and lightweight, the conventional cushions are widely used in various kinds of packages.

The external impact force may impact onto a surface or concentrate in a specific point of the box. Therefore, to protect the thin article from breaking of the external impact force, approaches can be used, under the condition of using a single material to form the box and internal packaging structures, such as enhancing the rigidity of the box (increasing the thickness of the box), increasing the internal buffer space (remaining space) of the box, enhancing rigidities of the packaging structures (complexity of the packaging structures), or disposing the packaging structures evenly at six surfaces in the box.

For example, almost all of the cushions used by display panels are formed according to appearances of the display panels, so as to entirely package, support, and fix the display panels. However, for a display panel with a portion having a special appearance (e.g., an edge of the display panel having a protruding hook structure), the portion often is the weakest point. A conventional cushion must be manufactured according to the portion, which makes the surface of the cushion used to hold the display panel significantly reduced (i.e., a large part of the display panel being suspending) and results in that the display panel cannot be firmly cushioned by the cushion and easily shakes. Therefore, if using the conventional cushion, the display panel with the portion having special appearance will be subject to deformation or damages in the box from the impact during stacking, storage, transportation, or dropping.

SUMMARY

In order to solve the problems of the prior art, the embodiments of the invention provides an improved cushion, in which a protruding structure disposed on a base plate of the cushion is particularly designed.

The protruding structure of the cushion of the embodiment of the invention includes a rotation block that can be pressed to bend. When a display panel with a portion having a special appearance is placed on the cushion, the portion of the display panel can press downwardly to bend the rotation block, so as to make the rotation block entirely package the portion and firmly fix the display panel at the same time. When the display panel is removed from the cushion, the portion of the display panel can be pulled upwardly to recover the bent rotation block and thus successfully finishing the removing action. In other words, the rotation block of the cushion not only can firmly fix display panel without shaking, but also can entirely package and reinforce the portion that has the weakest strength. Furthermore, the cushion of the embodiments of the invention can be used without additional operation manpower and actions.

According to an embodiment of the invention, a cushion is used to cushion an article. The cushion includes a base plate, a first protruding structure, and a second protruding structure. The base plate is used to support the article. The first protruding structure includes a main body and a rotation block. The main body is connected to the base plate. The rotation block is connected to the main body and capable of being bent to rotate toward the base plate relative to the main body. The second protruding structure is connected to the base plate. The article is clamped between the bent rotation block and the second protruding structure.

In an embodiment of the invention, the first protruding structure has an opening and a slit inwardly extending from the opening. The slit separates the main body and the rotation block. The slit is gradually expanded from the end of the slit toward the opening when the rotation block is bent.

In an embodiment of the invention, the first protruding structure has a bending edge. The bending edge is located between the main body and the rotation block. The slit and the bending edge are respectively located at two opposite sides of the rotation block. The rotation block rotates relative to the main body along the bending edge.

In an embodiment of the invention, the rotation block includes a first abutting portion and a second abutting portion that are connected to each other. The slit is located between the main body and the first abutting portion. The bending edge is located between the main body and the second abutting portion. The article is clamped between the first abutting portion of the bent rotation block and the second protruding structure.

In an embodiment of the invention, the first abutting portion has a first minimum thickness. The second abutting portion has a second minimum thickness. The first minimum thickness is substantially larger than 3 mm. The second minimum thickness is substantially larger than 3 mm.

In an embodiment of the invention, the first protruding structure and the second protruding structure are arranged along an arrangement direction. A cross section is parallel to the arrangement direction and perpendicular to the base plate. The first abutting portion and the second abutting portion that are connected to each other have a projection on the cross section. The projection is substantially L-shaped.

In an embodiment of the invention, the first abutting portion of the bent rotation block abuts against the article. A cushioning space is formed among the rotation block, the base plate, and the second protruding structure.

In an embodiment of the invention, the second protruding structure includes another main body and another rotation block. The article is clamped between the first abutting portion of the bent rotation block and the another main body of the second protruding structure.

In an embodiment of the invention, the rotation block has a connection distance between the end of the slit and the bending edge. The connection distance is substantially larger than 3 mm.

In an embodiment of the invention, the slit includes a first extension portion and a second extension portion. The first extension portion extends from the opening. The second extension portion is communicated to the end of the first extension portion. The first extension portion and the second extension portion substantially extend toward distinct directions.

In an embodiment of the invention, the first protruding structure and the second protruding structure are arranged along an arrangement direction. A cross section is parallel to the arrangement direction and perpendicular to the base plate. When the rotation block is not be bent, a projection of the slit on the cross section is substantially v-shaped.

In an embodiment of the invention, the first protruding structure and the second protruding structure are arranged along an arrangement direction. A cross section is parallel to the arrangement direction and perpendicular to the base plate. A projection of the rotation block on the cross section is substantially trapezoidal.

In an embodiment of the invention, the second protruding structure includes another main body and another rotation block. The article is clamped between the bent rotation block and the bent another rotation block.

In an embodiment of the invention, materials of the cushion include EPE (Extruded Polyethylene).

In an embodiment of the invention, the first protruding portion includes at least one high-density region. The high-density region is across a portion of the main body and a portion of the rotation block.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
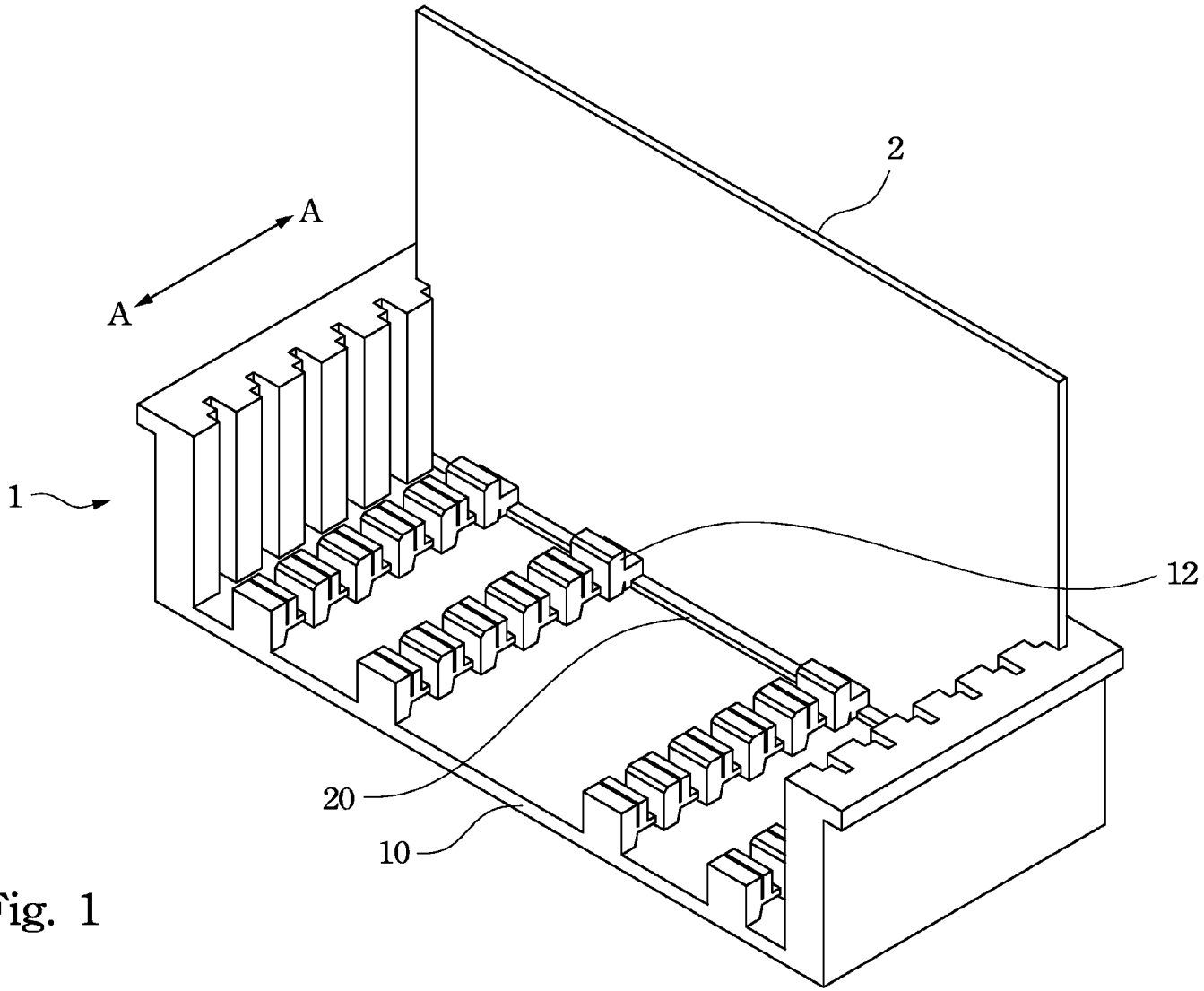
FIG. 1 is a perspective view of a cushion according to an embodiment of the invention, in which a display panel is cushioned on the cushion.

Reference will now be made in detail to the present embodiments of the invention, examples of which are illustrated in the accompanying drawings. Wherever possible, the same reference numbers are used in the drawings and the description to refer to the same or like parts.

An improved cushion is provided. Specifically, the cushion has a particularly designed protruding structure disposed on a base plate of the cushion. The protruding structure of the cushion of the invention includes a rotation block that can be pressed to bend. When a display panel with a portion having a special appearance is placed on the cushion, the portion of the display panel can press downwardly to bend the rotation block, so as to make the rotation block entirely package the portion and firmly fix the display panel at the same time. When the display panel is removed from the cushion, the portion of the display panel can be pulled upwardly to recover the bent rotation block and thus successfully finishing the removing action.

Figure 2A:
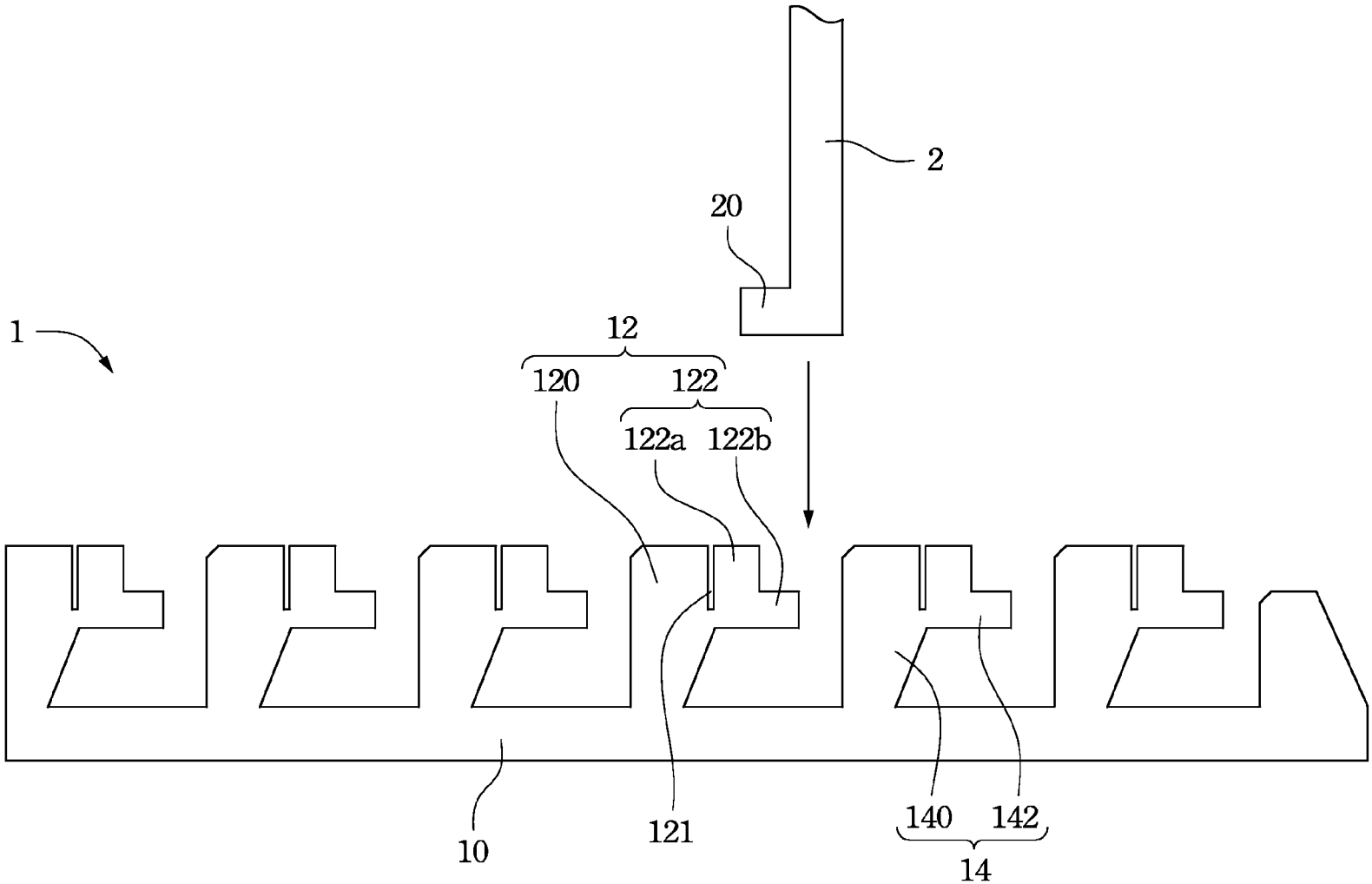
FIG. 2A is a sectional view of the cushion in the FIG. 1 on a cross section, in which a rotation block has not been bent.
Figure 2B:
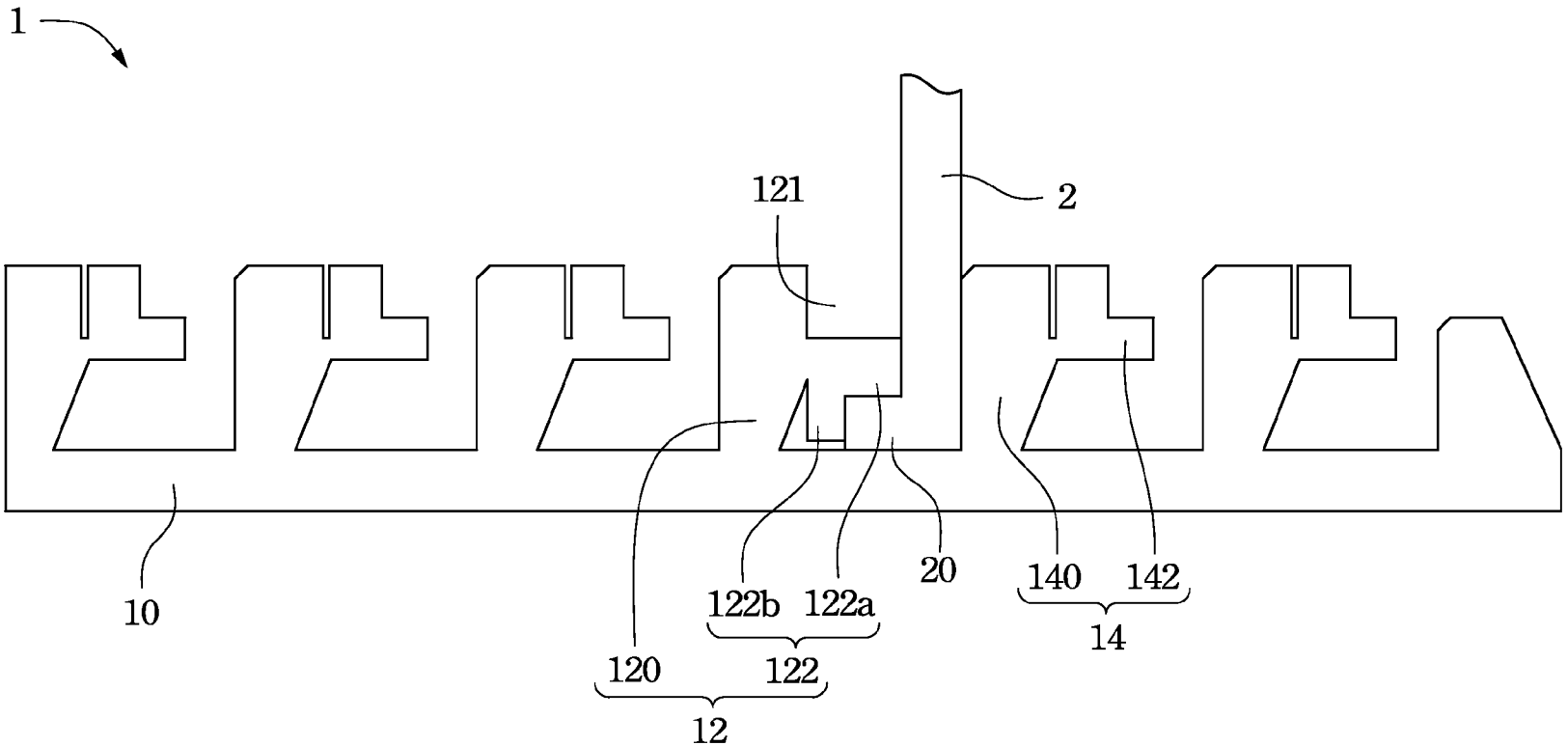
FIG. 2B is another sectional view of the cushion in the FIG. 1 on the cross section, in which the rotation block has been bent.

FIG. 1 is a perspective view of a cushion 1 according to an embodiment of the invention, in which a display panel 2 is cushioned on the cushion 1. FIG. 2A is a sectional view of the cushion 1 in the FIG. 1 on a cross section, in which a rotation block 122 has not been bent. FIG. 2B is another sectional view of the cushion 1 in the FIG. 1 on the cross section, in which the rotation block 122 has been bent.

As shown in FIG. 1, FIG. 2A, and FIG. 2B, the cushion 1 of the invention can be used to cushion and protect an article having special appearance. For example, the article can be the display panel 2 with a portion having a special appearance, but the invention is not limited thereto. That is, the cushion 1 of the invention can be used to cushion any electronic product during transportation. Furthermore, the cushion 1 manufactured according to concepts of the invention can entirely package, firmly fix, and cushion the portion having the special appearance. All embodiments of the invention used to cushion the display panel 2 with the portion having the special appearance are introduced in detail below.

As shown in FIG. 1, FIG. 2A, and FIG. 2B, the cushion 1 of the invention is used to cushion the display panel 2, and the lower edge of the display panel 2 has a protruding hook structure 20. The cushion 1 of the invention at least includes a base plate 10, a first protruding structure 12, and a second protruding structure 14, in which the first protruding structure 12 and the second protruding structure 14 are disposed at the same plane of the base plate 10 and arranged side by side. In the embodiment, the base plate 10, the first protruding structure 12, and the second protruding structure 14 are integrally formed, but the invention is not limited thereto. For example, the first protruding structure 12 and the second protruding structure 14 can also be engaged with or embedded in the base plate 10. The cross section shown in FIG. 2A and FIG. 2B is parallel to an arrangement direction of the first protruding structure 12 and the second protruding structure 14 and perpendicular to the base plate 10. The base plate 10 of the cushion 1 is used to support the display panel 2. The first protruding structure 12 of the cushion 1 includes a main body

120 and a rotation block 122. The main body 120 of the first protruding structure 12 is connected to the base plate 10. The rotation block 12 of the first protruding structure 12 is connected to the main body 120, and rotates away from its original position when forced (e.g., an assembly staff manually bends the rotation block 122 or downwardly presses the display panel 2 along the direction indicated by the arrow in FIG. 2A to bend the rotation block 122). In detail, the rotation block 122 is bent to rotate toward the base plate 10 relative to the main body 120. The second protruding structure 14 of the cushion 1 is connected to the base plate 10. Therefore, after the rotation block 122 of the first protruding structure 12 is bent, the display panel 2 can be clamped between the bent rotation block 122 and the second protruding structure 14. It is notable that the bent rotation block 122 means the rotation block 122 is rotated away from its original position relative to the first protruding structure 12 by an external force, but the external force does not deform the shape of the rotation block 122. Furthermore, after the rotation block 122 leaves its original position, the rotation block 122 can achieve the function of fixing articles.

Figure 3:
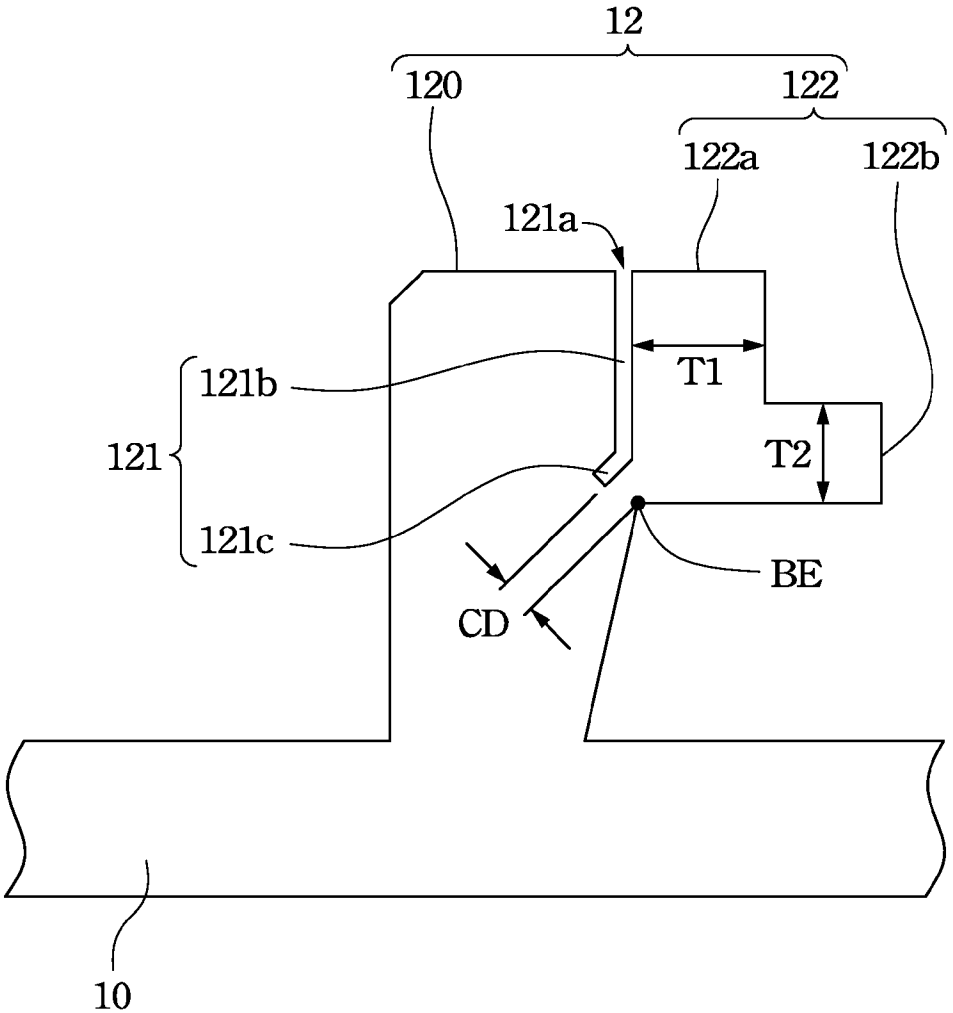
FIG. 3 is a partially enlarged view of the cushion in FIG. 2A.

FIG. 3 is a partially enlarged view of the cushion 1 in FIG. 2A.

As shown in FIG. 2A, FIG. 2B, and FIG. 3, the first protruding structure 12 of the cushion 1 has an opening 121*a* and a slit 121 inwardly extending from the opening 121*a*. The slit 121 of the first protruding structure 12 separates the main body 120 and the rotation block 122. When the rotation block 122 of the first protruding structure 12 is bent, the slit 121 that separates the main body 120 and the rotation block 122 is gradually expanded from the end of the slit 121 (i.e., the end of the slit 121 away from the opening 121*a*) toward the opening 121*a* (i.e., the slit 121 is expanded). Furthermore, the first protruding structure 12 of the cushion 1 has a bending edge BE. The bending edge BE of the first protruding structure 12 is located between the main body 120 and the rotation block 122 (i.e., the bending edge BE is the boundary line between the main body 120 and the rotation block 122). The slit 121 and the bending edge BE of the first protruding structure 12 are respectively located at two opposite sides of the rotation block 122. The rotation block 122 of the first protruding structure 12 rotates relative to the main body 120 along the bending edge BE. In other words, the bending edge BE is the pivot of the rotation block 122, so the rotation block 122 can be bent to rotate toward the base plate 10.

As shown in FIG. 2A, FIG. 2B, and FIG. 3, the rotation block 122 of the first protruding structure 12 includes a first abutting portion 122*a* and a second abutting portion 122*b*. The first abutting portion 122*a* and the second abutting portion 122*b* are connected to each other. The slit 121 of the first protruding structure 12 is located between the main body 120 and the first abutting portion 122*a*. The bending edge BE of the first protruding structure 12 is located between the main body 120 and the second abutting portion 122*b*. In the embodiment, the first abutting portion 122*a* and the second abutting portion 122*b* that are connected to each other have a projection on the cross section in FIG. 2A and FIG. 2B, and the projection is substantially L-shaped, but the invention is not limited thereto.

Therefore, the display panel 2 can be clamped between the first abutting portion 122*a* of the bent rotation block 122 and the second protruding structure 14. Furthermore, when the first abutting portion 122*a* of the bent rotation block 122 abuts against the display panel 2, a cushioning space formed among the rotation block 122, the base plate 10, and the second protruding structure 14 can entirely package the portion having the special appearance (i.e., the protruding hook structure 20 at the lower edge of the display panel 2). In detail, the display panel 2 is clamped between the first abutting portion 122*a* of the rotation block 122 and the second protruding structure 14, and the portion having the special appearance of the display panel 2 is clamped between the first abutting portion 122*a* of the rotation block 122 and the base plate 10 and between the second abutting portion 122*b* of the rotation block 122 and the second protruding structure 14.

As shown in FIG. 2A and FIG. 2B, the second protruding structure 14 of the cushion 1 includes another main body 140 and another rotation block 142. The display panel 2 is clamped between first abutting portion 122*a* of the bent rotation block 122 and the another main body 140 of the second protruding structure 14, but the invention is not limited thereto. In another embodiment, the second protruding structure 14 of the cushion 1 can only includes the another 140 without the another rotation block 142 (as the rightmost protruding structure in FIG. 2A and FIG. 2B).

In a practical case, if the second protruding structure 14 is located at an edge of the base plate 10, the display panel 2 is clamped between a side of the another main body 140 of the second protruding structure 14 and the first abutting portion 122*a* of the adjacent first protruding structure 12, and another side of the another main body 140 of the second protruding structure 14 does not abut against another display panel 2. In another practical case, if the second protruding structure 14 is located between two first protruding structures 12, the display panel 2 is clamped between a side of the another main body 140 of the second protruding structure 14 and the first abutting portion 122*a* of the adjacent first protruding structure 12, and another display panel 2 is clamped between another side of the another main body 140 of the second protruding structure 14 and the first abutting portion 122*a* of the another adjacent first protruding structure 12.

As shown in FIG. 3, the first abutting portion 122*a* of the rotation block 122 has a first minimum thickness T1. The second abutting portion 122*b* of the rotation block 122 has a second minimum thickness T2. The first minimum thickness T1 of the first abutting portion 122*a* is substantially larger than 3 mm. The second minimum thickness T2 of the second abutting portion 122*b* is substantially larger than 3 mm. By making the first minimum thickness T1 of the first abutting portion 122*a* and the second minimum thickness T2 of the second abutting portion 122*b* be substantially larger than 3 mm, the embodiment of the invention can provide the rotation block 122 enough structural strength and stability while abutting against the display panel 2.

As shown in FIG. 3, the rotation block 122 of the first protruding structure 12 has a connection distance CD between the end of the slit 121 and the bending edge BE. The connection distance CD between the end of the slit 121 and the bending edge BE is substantially larger than 3 mm. By making the connection distance CD between the end of the slit 121 and the bending edge BE be substantially larger than 3 mm, the embodiment of the invention can prevent the rotation block 122 of the first protruding structure 12 from fracture while been bent relative to the main body 120.

As shown in FIG. 3, the slit 121 that separates the main body 120 and the rotation block 122 includes a first extension portion 121*b* and a second extension portion 121*c*. The first extension portion 121*b* of the slit 121 extends from the opening 121*a*. The second extension portion 121*c* of the slit 121 is communicated to the end of the first extension portion 121*b*. Particularly, the first extension portion 121*b* and the second extension portion 121*c* of the slit 121 substantially extend toward distinct directions. For example, the first extension portion 121*b* of the slit 121 substantially extends toward the bending edge BE between the main body 120 and the rotation block 122, and the second extension portion 121*c* of the slit 121 deviates from the direction facing toward the bending edge BE and substantially extends toward the center of the main body 120, but the invention is not limited thereto. By making the first extension portion 121*b* and the second extension portion 121*c* of the slit 121 substantially extend toward distinct directions, the embodiment of the invention can also prevent the rotation block 122 of the first protruding structure 12 from fracture while been bent relative to the main body 120.

Moreover, a surface of the main body 120 of the first protruding structure 12 between the bending edge BE and the base plate 10 can be an inclined surface as shown in FIG. 2B, and the inclined surface and the bent rotation block 122 can form a space (similar to a triangle shown in FIG. 2B). The inclined surface is able to assist the convenience of manufacturing the cushion 1, but the invention is not limited thereto.

Figure 4A:
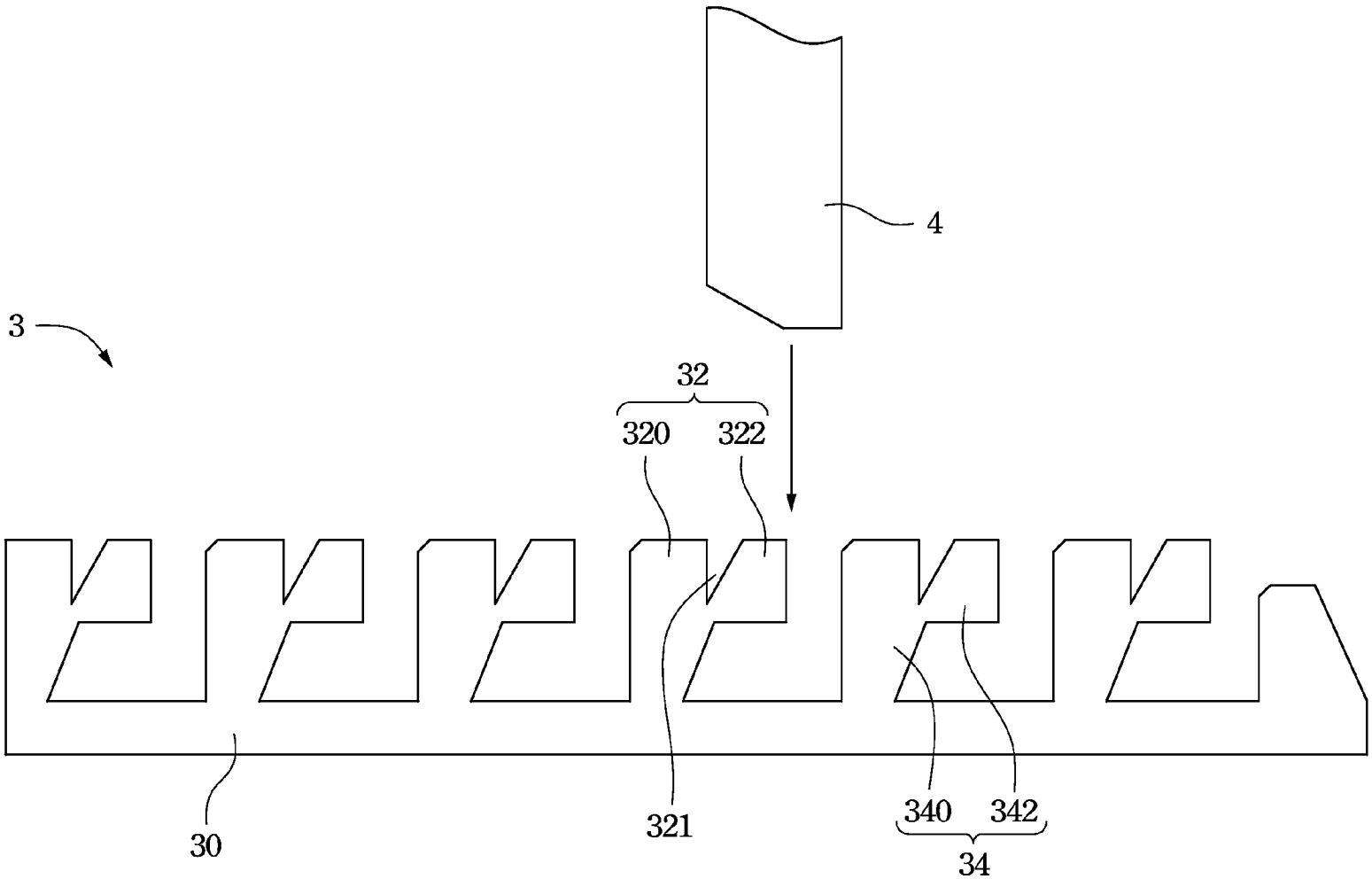
FIG. 4A is a sectional view of a cushion on a cross section according to another embodiment of the invention, in which a rotation block has not been bent.
Figure 4B:
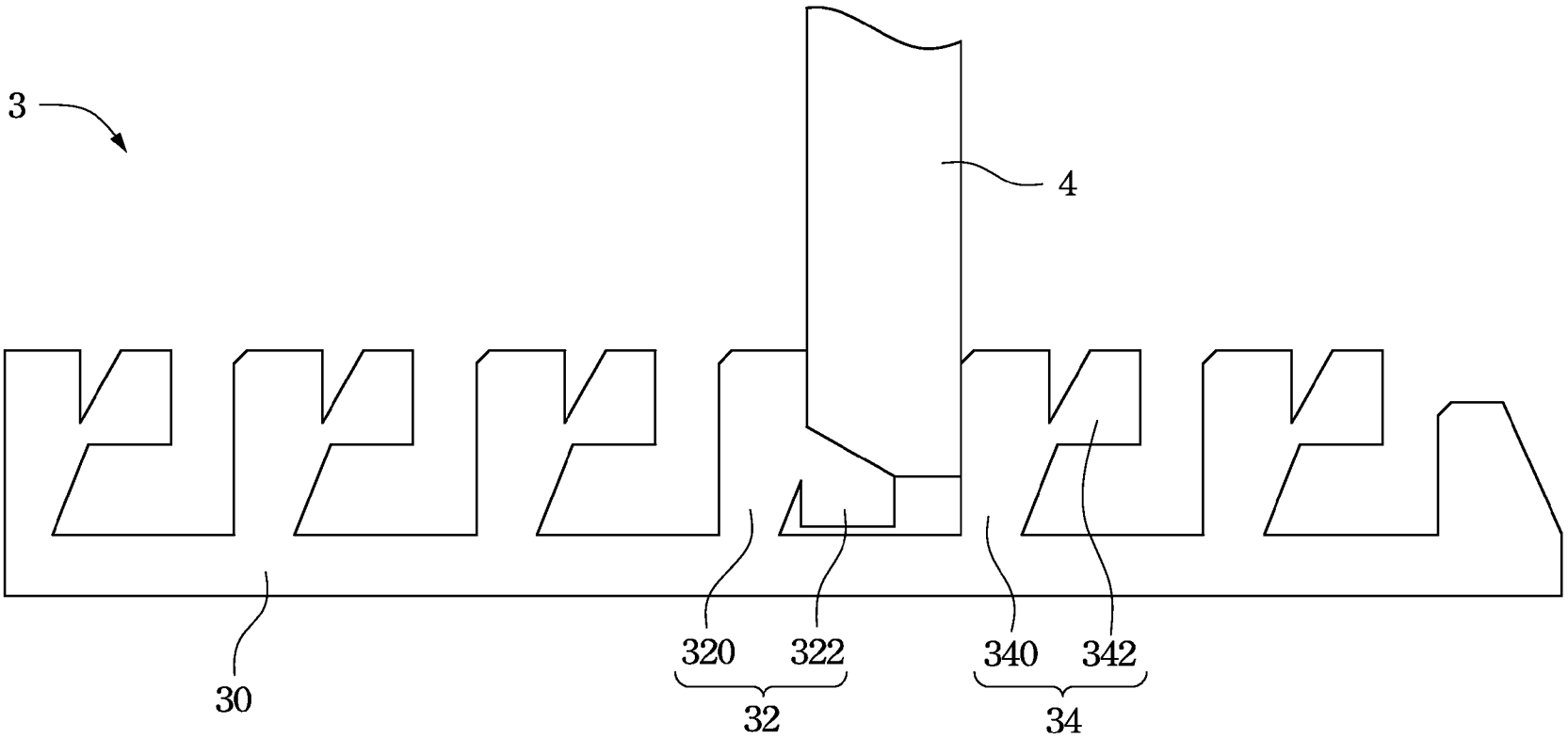
FIG. 4B is another sectional view of the cushion in the FIG. 4A on the cross section, in which the rotation block has been bent.

FIG. 4A is a sectional view of a cushion 3 on a cross section according to another embodiment of the invention, in which a rotation block 322 has not been bent. FIG. 4B is another sectional view of the cushion 3 in the FIG. 4A on the cross section, in which the rotation block 322 has been bent.

As shown in FIG. 4A and FIG. 4B, the cushion 3 also at least includes a base plate 30, a first protruding structure 32, and a second protruding structure 34. The first protruding structure 32 of the cushion 3 includes a main body 320 and a rotation block 322 that are connected to each other. The main body 320 of the first protruding structure 32 is connected to the base plate 30. The rotation block 322 of the first protruding structure 32 is connected to the main body 320 and can be bent to rotate toward the base plate 30 relative to the main body 320 (e.g., an assembly staff manually bends the rotation block 322 or downwardly presses the display panel 4 along the direction indicated by the arrow in FIG. 4A to bend the rotation block 322). The second protruding structure 34 of the cushion 3 is connected to the base plate 30. The second protruding structure 34 also includes another main body 340 and another rotation block 342 that are connected to each other. The another rotation block 342 of the second protruding structure 34 is connected to the another main body 340 and can be bent to rotate toward the base plate 30 relative to the another main body 340. The display panel 4 that is supported on the base plate 30 of the cushion 3 of the embodiment and the display panel 2 shown in FIG. 2B have distinct appearances. The structure of an edge of the display panel 4 of the embodiment is similar to a chamfer.

In the embodiment, the first protruding structure 32 also includes a slit 321. The slit 321 separates the main body 320 and the rotation block 322. When the rotation block 322 of the first protruding structure 32 has not been bent, a projection of the slit 321 of the first protruding structure 32 on the cross section is substantially v-shaped, but the invention is not limited thereto. Furthermore, a projection of the rotation block 322 of the first protruding structure 32 on the cross section is substantially trapezoidal, but the invention is not limited thereto. Therefore, after the rotation block 322 of the first protruding structure 32 is bent, the display panel 4 can be supported on the bent rotation block 322 and clamped between the main body 320 of the first protruding structure 32 and the another main body 340 of the second protruding structure 34. Meanwhile, both the main body 320 and the rotation block 322 that are separated at two sides of the slit 321 of the first protruding structure 32 abut against the display panel 4. Therefore, an inclined surface of the rotation block 322 formed by bending the rotation block 322 (i.e., the surface of the rotation block 322 that forms the slit 321) can abut against the display panel 4. The inclined surface formed by the bent rotation block 322 can be adjusted according to different designs of display panels.

Moreover, a surface of the main body 320 of the first protruding structure 32 between the rotation block 322 and the base plate 30 can be an inclined surface as shown in FIG. 4B, and the inclined surface and the bent rotation block 322 can form a space (similar to a triangle shown in FIG. 4B). The inclined surface is able to assist the convenience of manufacturing the cushion 3, but the invention is not limited thereto.

Figure 5:
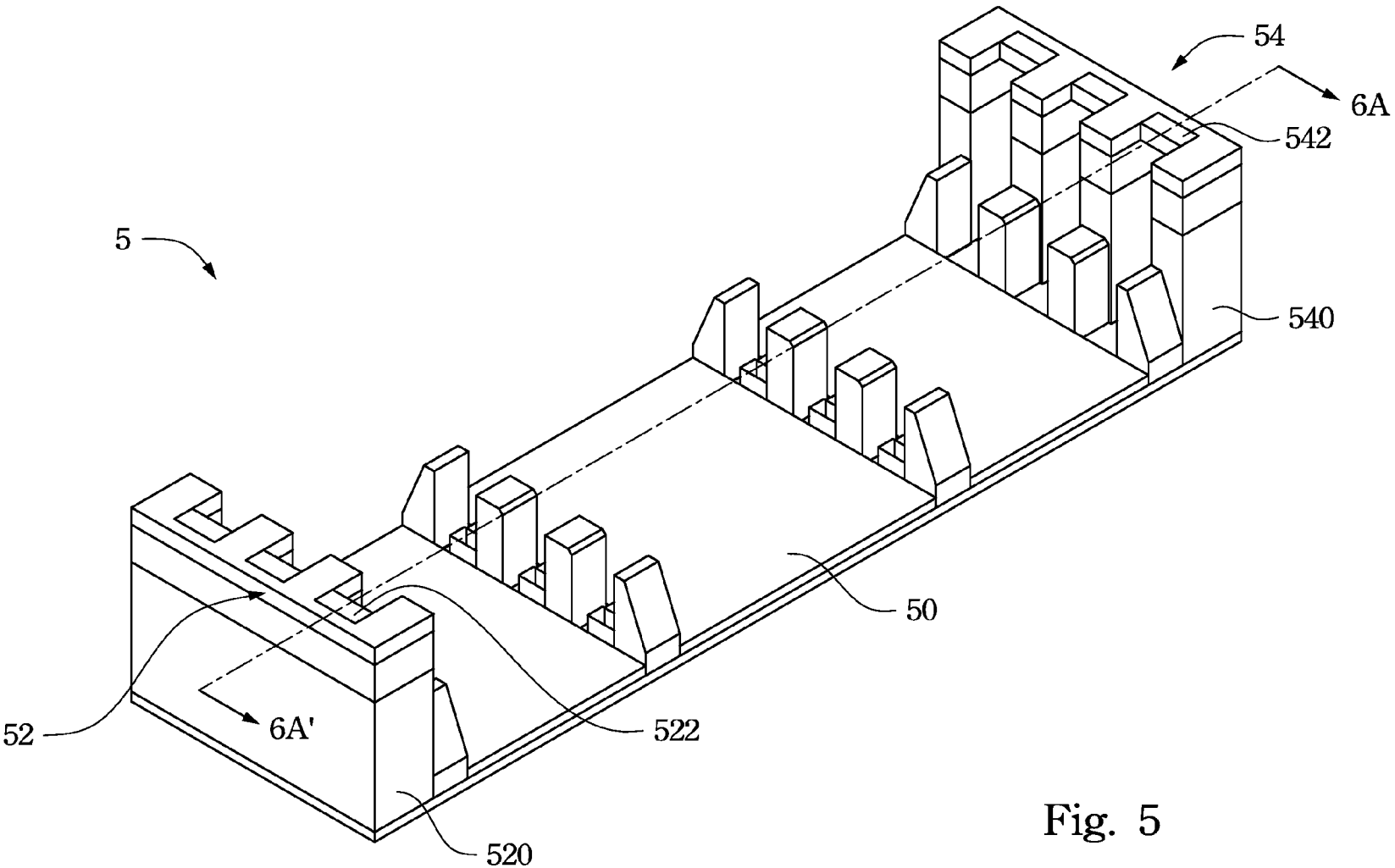
FIG. 5 is a perspective view of a cushion according to another embodiment of the invention.
Figure 6A:
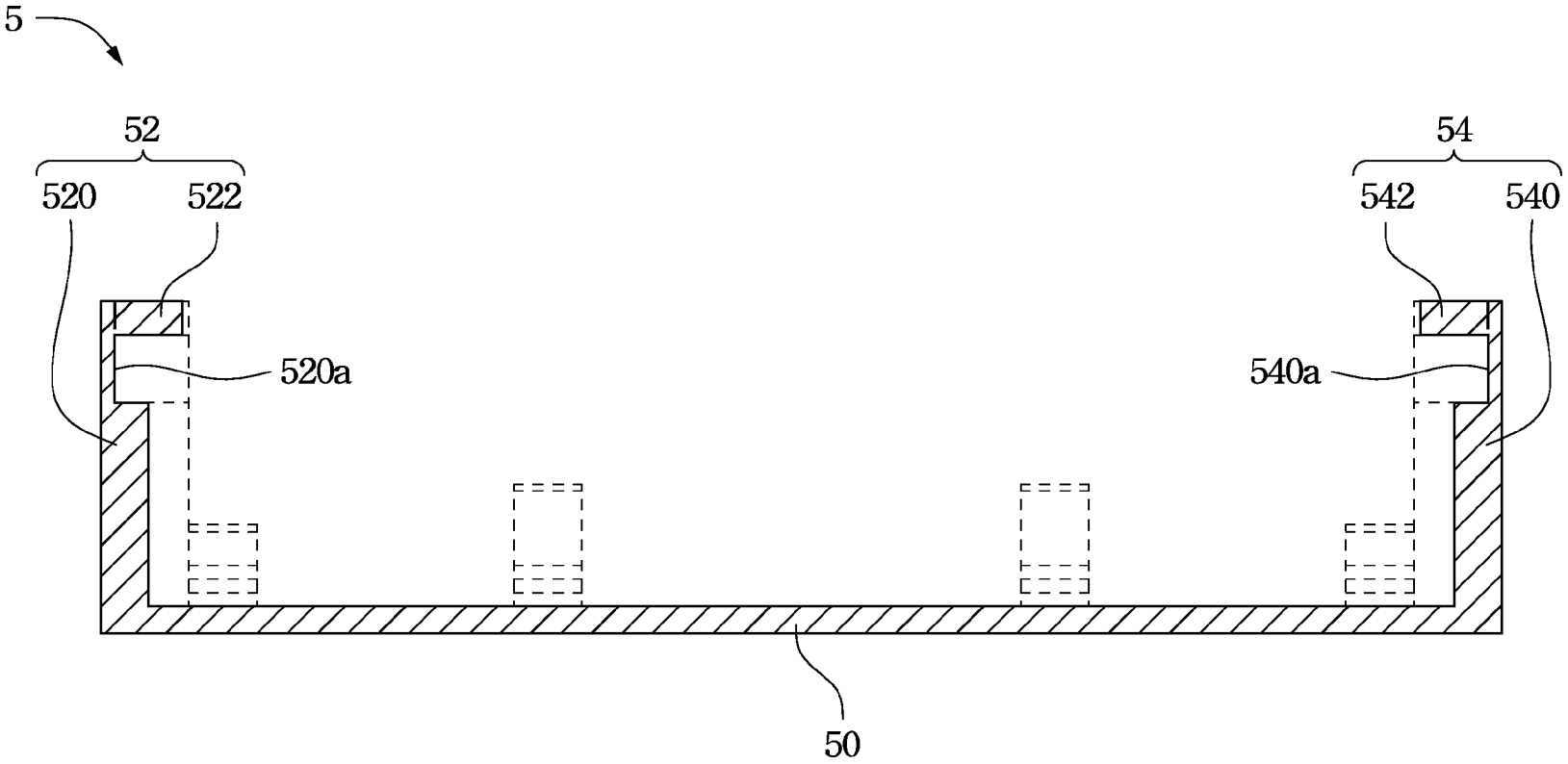
FIG. 6A is a sectional view of the cushion in FIG. 5 along line 6A-6A', in which a rotation block and another rotation block have not been bent.
Figure 6B:
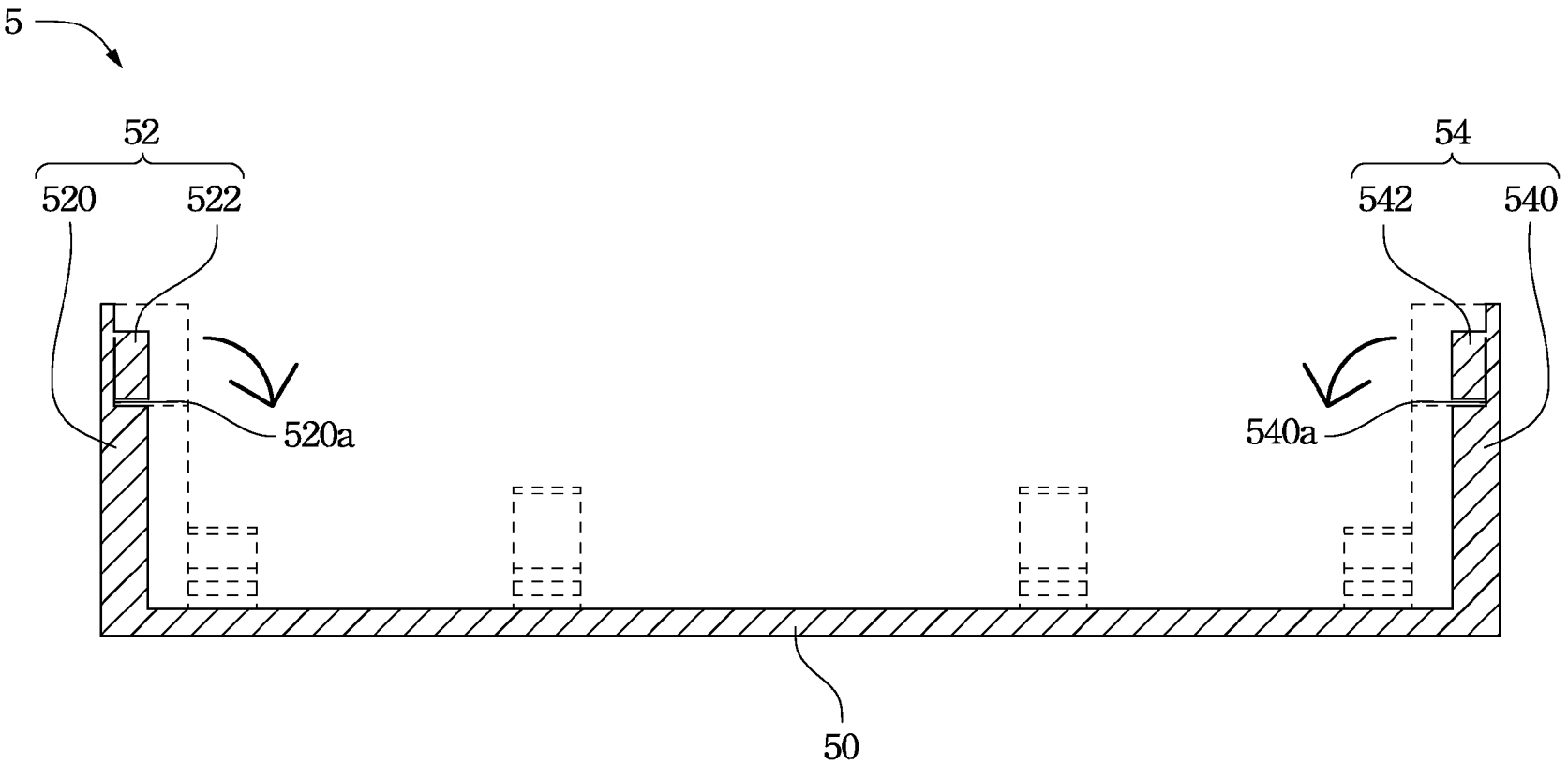
FIG. 6B is another sectional view of the cushion in FIG. 6A, in which the rotation block and the another rotation block have been bent.

FIG. 5 is a perspective view of a cushion 5 according to another embodiment of the invention. FIG. 6A is a sectional view of the cushion 5 in FIG. 5 along line 6A-6A', in which a rotation block 522 and another rotation block 542 have not been bent. FIG. 6B is another sectional view of the cushion 5 in FIG. 6A, in which the rotation block 522 and the another rotation block 542 have been bent.

As shown in FIG. 5, FIG. 6A, and FIG. 6B, the cushion 5 also at least includes a base plate 50, a first protruding structure 52, and a second protruding structure 54. The first protruding structure 52 of the cushion 5 includes a main body 520 and a rotation block 522 that are connected to each other. The main body 520 of the first protruding structure 52 is connected to the base plate 50. The rotation block 522 of the first protruding structure 52 is connected to the main body 520 and bent to rotate toward the base plate 50 relative to the main body 520. The second protruding structure 54 of the cushion 5 is connected to the base plate 50. The second protruding structure 54 also includes another main body 540 and another rotation block 542 that are connected to each other. Another rotation block 542 of the second protruding structure 54 is connected to another main body 540 and can be bent to rotate toward the base plate 50 relative to the another main body 540. It is notable that the main body 520 of the first protruding structure 52 further has a groove 520*a*. The groove 520*a* of the main body 520 is adjacent to the rotation block 522 and can accommodates the rotation block 522 when the rotation block 522 is bent. Another main body 540 of the second protruding structure 54 further has another groove 540*a*. Another groove 540*a* of another main body 540 is adjacent to another rotation block 542 and can accommodates another rotation block 542 when another rotation block 542 is bent. When the display panel 2 or the display panel 4 is put into the cushion 5, edges of two sides of the display panel 2 or the display panel 4 respectively press the rotation block 522 of the first protruding structure 52 to rotate relative to the main body 520 and then be accommodated in the groove 520*a* and press the another rotation block 542 of the second protruding structure 54 to rotate relative to the another main body 540 and then be accommodated in the groove 520*a*. Therefore, the display panel 2 or the display panel 4 can be firmly clamped between the first protruding structure 52 and the second protruding structure 54.

When a conventional cushion is used to package two display panels, a wall or a spacer is always additionally disposed in the conventional cushion to position the display panel that is put into the conventional cushion first, so as to prevent the display panel from falling down in the conventional cushion. Compared with the conventional cushion, the display panel 2 or the display panel 4 can be clamped between the rotation block 522 of the first protruding structure 52 and another rotation block 542 of the second protruding structure 54 of the cushion 5. Therefore, the problem of falling down does not occur in the embodiment, and another display panel 2 or another display panel 4 can be subsequently put into the cushion 5 without using the wall or the spacer in advance.

Figure 7A:
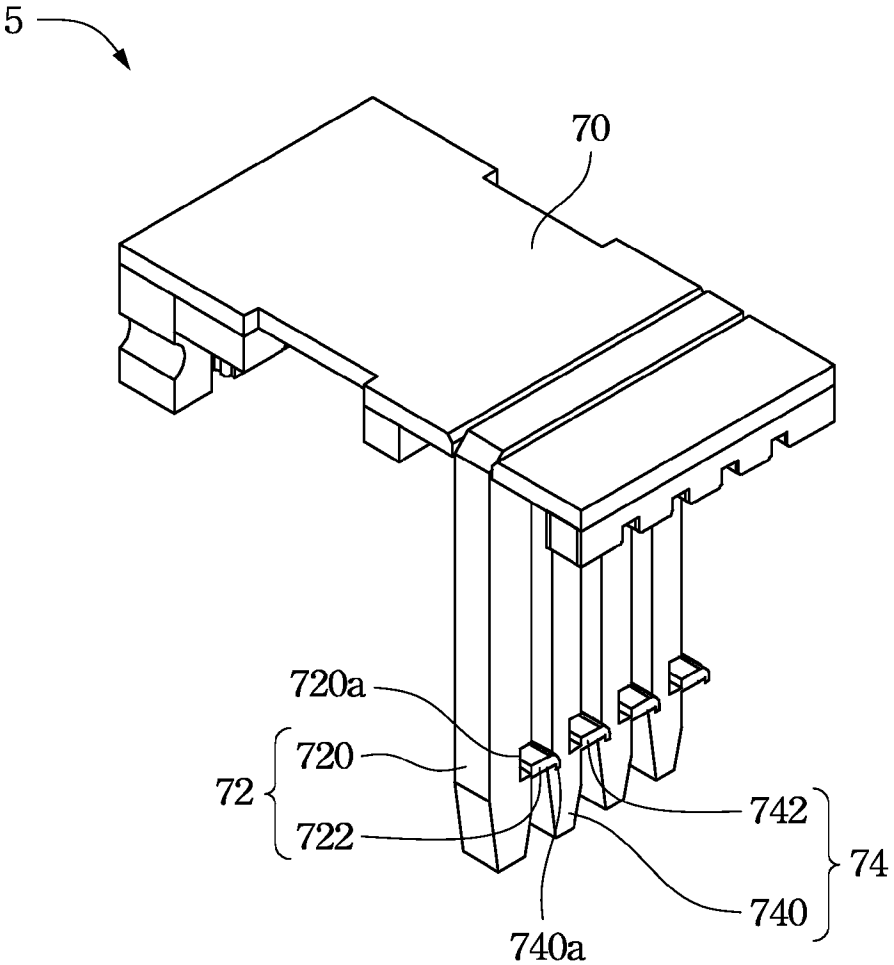
FIG. 7A is a perspective view of a cushion according to another embodiment of the invention.
Figure 7B:
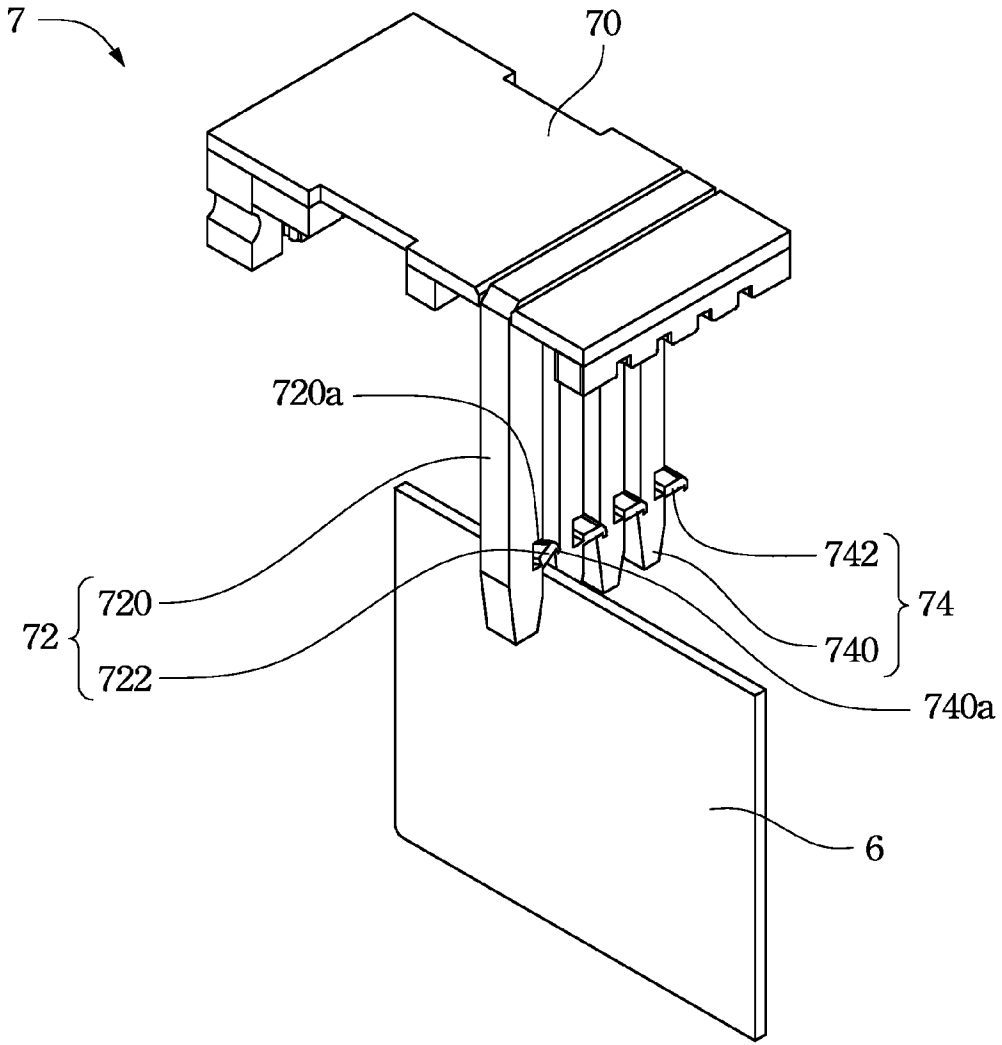
FIG. 7B is another perspective view of the cushion in FIG. 7A, in which a display panel abuts against and bends a rotation block.
Figure 7C:
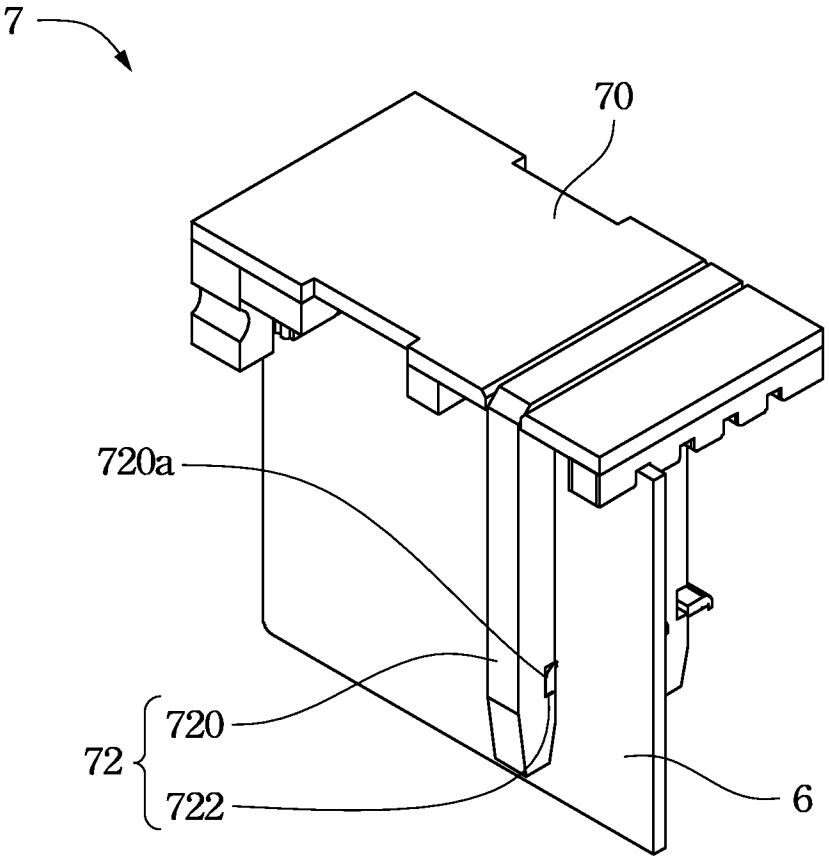
FIG. 7C is another perspective view of the cushion in FIG. 7A, in which the display panel is cushioned on the cushion.

FIG. 7A is a perspective view of a cushion 7 according to another embodiment of the invention. FIG. 7B is another perspective view of the cushion 7 in FIG. 7A, in which a display panel 6 abuts against and bends a rotation block 722. FIG. 7C is another perspective view of the cushion 7 in FIG. 7A, in which the display panel 6 is cushioned on the cushion 7.

As shown in FIG. 7A, FIG. 7B, and FIG. 7C, the cushion 7 also at least includes a base plate 70, a first protruding structure 72, and a second protruding structure 74. The first protruding structure 72 of the cushion 7 includes a main body 720 and a rotation block 722 that are connected to each other. The main body 720 of the first protruding structure 72 is connected to the base plate 70. The rotation block 722 of the first protruding structure 72 is connected to the main body 720 and can be bent to rotate toward the base plate 70 relative to the main body 720. The second protruding structure 74 of the cushion 7 is connected to the base plate 70. The second protruding structure 74 also includes another main body 740 and another rotation block 742 that are connected to each other. Another rotation block 742 of the second protruding structure 74 is connected to another main body 740 and can be bent to rotate toward the base plate 70 relative to the another main body 740.

The main body 720 of the first protruding structure 72 further has a groove 720*a*. The groove 720*a* of the main body 720 is adjacent to the rotation block 722 and can accommodates the rotation block 722 when the rotation block 722 is bent. Another main body 740 of the second protruding structure 74 further has an engaging notch 740*a*. The engaging notch 740*a* of another main body 740 faces the side of the main body 720 on which the groove 720*a* is disposed. That is, when there are pluralities of first protruding structures 72 and second protruding structures 74 arranged side by side (as shown in FIG. 7A, FIG. 7B, and FIG. 7C), each of the protruding structures between the outermost two protruding structures has a groove 720*a* and an engaging notch 740*a* respectively disposed at its two sides (as the second protruding structure 74 in FIG. 7A). The rotation block 722 and the groove 720*a* are disposed at the same side of the first protruding structure 72, and the rotation block 722 faces the engaging notch 740*a* of an adjacent protruding structure. Furthermore, one of the outermost protruding structure (as the first protruding structure 72 in FIG. 7A) only includes the groove 720*a* and the rotation block 722 at the same side facing the adjacent protruding structure (as the second protruding structure 74 in FIG. 7A), and another of the outermost protruding structure (as the rightmost protruding structure in FIG. 7A) only includes the engaging notch 740*a* facing the adjacent protruding structure. When the rotation block 722 of the first protruding structure 72 has not been bent, the rotation block 722 extends between the main body 720 of the first protruding structure 72 and another main body 740 of the second protruding structure 74 (i.e., the rotation block 722 closes the gap between the main body 720 and the another main body 740), and the rotation block 722 is engaged with the engaging notch 740*a* of the another main body 740, as shown in FIG. 7A. When the display panel 6 inserts into the gap between the main body 720 and the another main body 740 and bends the rotation block 722 of the first protruding structure 72, the rotation block 722 is bent relative to the main body 720 to rotate toward the base plate 70 and leave the engaging notch 740*a*, as shown in FIG. 7B. When the display panel 6 entirely inserts into the cushion 7, the rotation block 722 of the first protruding structure 72 is bent by the display panel 6 and accommodated in the groove 720*a* of the main body 720, and the display panel 6 is located at the gap between the main body 720 and the another main body 740. Moreover, the recovering force of the bent rotation block 722 of the first protruding structure 72 pushes the display panel 6 toward the another main body 740 of the second protruding structure 74. In other words, the display panel 6 is clamped between the bent rotation block 722 of the first protruding structure 72 and another main body 740 of the second protruding structure 74.

Because protruding structures of the conventional cushion do not include rotation blocks, the gap between two adjacent protruding structures is hardly to be kept due to deformation or other factors, so that the efficiency of packaging is reduced. Compared with the conventional cushion, the rotation block 722 of the first protruding structure 72 of the cushion 7 can be used to keep the gap between the main body 720 of the first protruding structure 72 and the another main body 740 of the second protruding structure 74, so as to improve the efficiency of packaging.

In another embodiment, during the operation of putting the display panel 6 into the cushion 7, the rotation block 722 of the first protruding structure 72 can be bent manually, and the display panel 6 is then inserted into the gap between the main body 720 and the another main body 740.

In the embodiment, materials of the cushion 1 include EPE (Extruded Polyethylene), but the invention is not limited thereto. For example, materials of the cushion 1 can also include rubber, EPP (Expanded Polypropylene), etc. The reason why the invention use EPE to be one of the materials of the cushion 1 is that EPE is not too hard and has enough toughness, so the cushion 1 is hard to be broken when bent.

Figure 8:
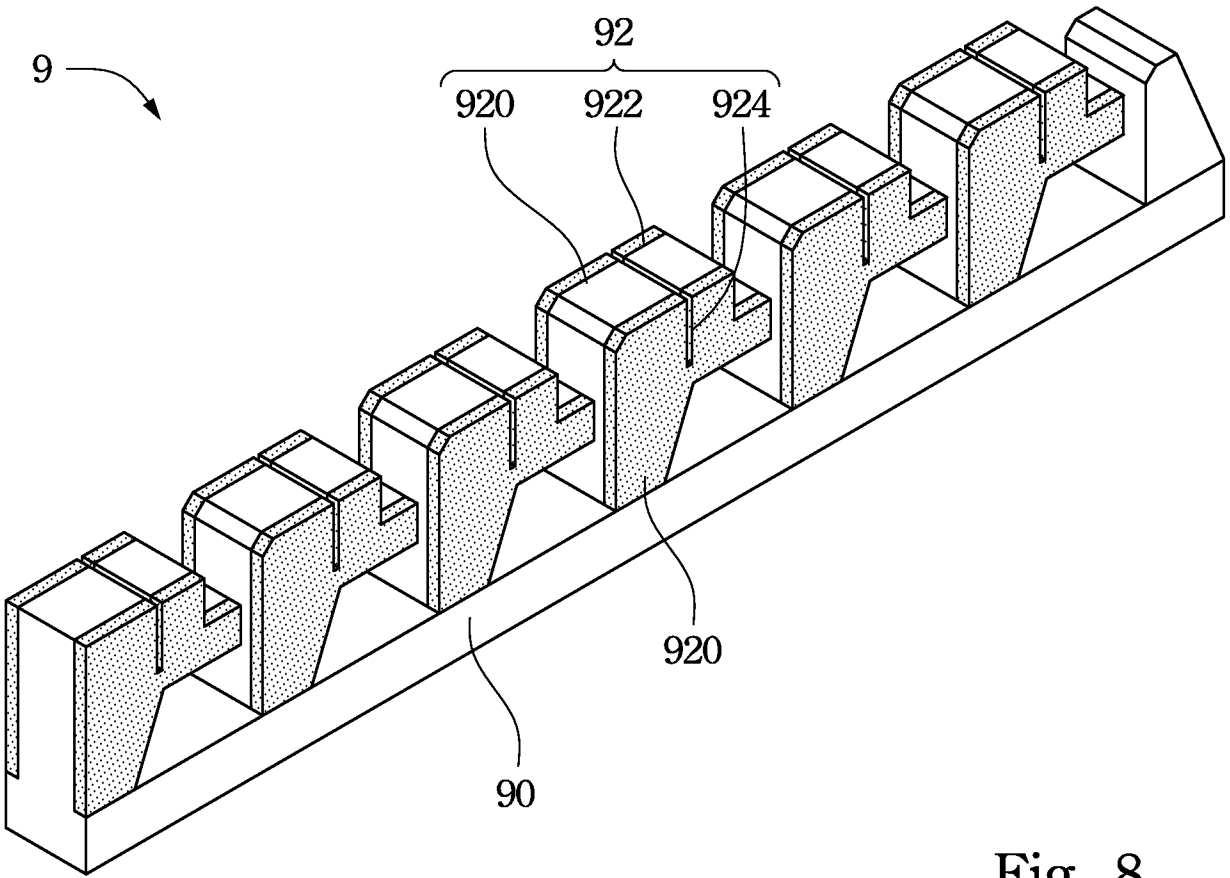
FIG. 8 is a partially perspective view of a cushion according to another embodiment of the invention.

FIG. 8 is a partially perspective view of a cushion 9 according to another embodiment of the invention.

As shown in FIG. 8, the cushion 9 at least includes a base plate 90 and a first protruding structure 92. The first protruding structure 92 of the cushion 9 includes a main body 920 and a rotation block 922 that are connected to each other. The main body 920 of the first protruding structure 92 is connected to the base plate 90. The rotation block 922 of the first protruding structure 92 is connected to the main body 920 and can be bent to rotate toward the base plate 90 relative to the main body 920. The first protruding portion 92 includes two high-density regions 924. The high-density regions 924 are across a portion of the main body 920 and a portion of the rotation block 922 along an arrangement direction of the first protruding structure 92. The high-density regions 924 are located at two sides of the first protruding structure 92 so as to form a sandwich-like structure (i.e., a structure having a normal-density region located between the high-density regions 924), but the invention is not limited thereto. In another case, the high-density region 924 can also be located at the center of the first protruding structure 92, so as to form another sandwich-like structure (i.e., a structure having a high-density region located between two normal-density regions). Furthermore, the high-density region 924 can also be disposed at the connection portion or a bending edge between the rotation block 922 and the main body 920 so as to enhance the structural strength of the cushion 9. In other words, by making certain portion of the first protruding structure 92 with EPE having high density, the invention can prevent the rotation block 922 of the first protruding structure 92 from been broken when bent relative to the main body 920.

According to the foregoing recitations of the embodiments of the invention, it can be seen that the cushion of the invention has a protruding structure disposed on a base plate of the cushion, and the protruding structure is particularly designed. The protruding structure of the cushion of the invention includes a rotation block that can be pressed to bend. When a display panel with a portion having a special appearance is placed on the cushion, the portion of the display panel can press downwardly to bend the rotation block, so as to make the rotation block entirely package the portion and firmly fix the display panel at the same time. When the display panel is removed from the cushion, the portion of the display panel can be pulled upwardly to recover the bent rotation block and thus successfully finishing the removing action. In other words, the rotation block of the cushion not only can firmly fix display panel without shaking, but also can entirely package and reinforce the portion that has the weakest strength. Furthermore, the cushion of the invention can be used without additional operation manpower and actions.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A cushion for cushioning an article, the cushion comprising:

abuse plate for supporting the article;

a first protruding structure comprising:

a main body connected to the base plate; and a rotation block connected to the main body and capable of being bent to rotate toward the base plate relative to the main body, wherein the rotation block comprises a first abutting portion and a second abutting portion that are connected to each other; and a second protruding structure connected to the base plate, wherein the article is clamped between the bent rotation block and the second protruding structure;

wherein the first protruding structure has an opening and a slit inwardly extending from the opening, the slit separates the main body and the rotation block and is gradually expanded from the end of the slit toward the opening when the rotation block is bent, the first protruding structure has a bending edge located between the main body and the rotation block, the slit and the bending edge are respectively located at two opposite sides of the rotation block, the rotation block rotates relative to the main body along the bending edge, the slit is located between the main body and the first abutting portion, the bending edge is located between the main body and the second abutting portion, and the article is clamped between the first abutting portion of the bent rotation block and the second protruding structure.

2. The cushion of claim 1, wherein the first abutting portion has a first minimum thickness, the second abutting portion has a second minimum thickness, the first minimum thickness is substantially larger than 3 mm, and the second minimum thickness is substantially larger than 3 mm.

3. The cushion of claim 1, wherein the first protruding structure and the second protruding structure are arranged along an arrangement direction, a cross section is parallel to the arrangement direction and perpendicular to the base plate, the first abutting portion and the second abutting portion that are connected to each other have a projection on the cross section, and the projection is substantially L-shaped.

4. The cushion of claim 3, wherein the first abutting portion of the bent rotation block abuts against the article, and a cushioning space is formed among the rotation block, the base plate, and the second protruding structure.

5. The cushion of claim 1, wherein the second protruding structure comprises another main body and another rotation block, and the article is clamped between the first abutting portion of the bent rotation block and the another main body of the second protruding structure.

6. The cushion of claim 1, wherein the rotation block has a connection distance between the end of the slit and the bending edge, and the connection distance is substantially larger than 3 mm.

7. The cushion of claim 1, wherein the slit comprises a first extension portion and a second extension portion, the first extension portion extends from the opening, the second extension portion is communicated to the end of the first extension portion, and the first extension portion and the second extension portion substantially extend toward distinct directions.

8. The cushion of claim 1, wherein the first protruding structure and the second protruding structure are arranged along an arrangement direction, a cross section is parallel to the arrangement direction and perpendicular to the base plate, and when the rotation block is not be bent, a projection of the slit on the cross section is substantially v-shaped.

9. The cushion of claim 1, wherein the first protruding structure and the second protruding structure are arranged along an arrangement direction, a cross section is parallel to the arrangement direction and perpendicular to the base plate, and a projection of the rotation block on the cross section is substantially trapezoidal.

10. The cushion of claim 1, wherein the second protruding structure comprises another main body and another rotation block, and the article is clamped between the bent rotation block and the bent another rotation block.

11. The cushion of claim 1, wherein materials of the cushion comprise EPE (Extruded Polyethylene).

12. The cushion of claim 11, wherein the first protruding portion comprises at least one high-density region across a portion of the main body and a portion of the rotation block.

* * * * *